United States Patent [19]

Rogers, Jr.

[11] Patent Number: 4,536,029

[45] Date of Patent: Aug. 20, 1985

[54] ROCKING CHAIR

[75] Inventor: Walter C. Rogers, Jr., Denton, N.C.

[73] Assignee: Parma Corporation, Denton, N.C.

[21] Appl. No.: 480,255

[22] Filed: Mar. 30, 1983

[51] Int. Cl.[3] ..... A47D 13/10

[52] U.S. Cl. ..... 297/281; 297/263; 297/349

[58] Field of Search ..... 297/281, 282, 273, 349, 297/261, 276, 258, 263

[56] References Cited

U.S. PATENT DOCUMENTS

| | | | |
|---|---|---|---|
| 383,808 | 5/1888 | Hall | 297/261 |
| 1,210,739 | 1/1917 | Warner | 297/282 |
| 2,296,603 | 9/1942 | Feldman | 297/281 |
| 2,634,793 | 4/1953 | Peterson | 297/273 X |
| 3,047,334 | 7/1962 | Vanderminden | 297/281 X |
| 3,994,468 | 11/1976 | Carter et al. | 297/281 X |

FOREIGN PATENT DOCUMENTS

| | | | |
|---|---|---|---|
| 574307 | 12/1945 | United Kingdom | 297/281 |
| 1097460 | 1/1968 | United Kingdom | 297/263 |

*Primary Examiner*—James T. McCall

*Attorney, Agent, or Firm*—William E. Mouzavires

[57] ABSTRACT

A rocking chair whose rocking action is achieved solely through a linkage mechanism rather than rocking cams conventionally employed. The chair includes upholstered seat, backrest and armrests which are united in a one-piece structure mounted on a fixed base by means of the linkage mechanism. In the preferred embodiment, the base is provided with a swivel enabling the chair to swivel about a vertical axis. The linkage mechanism allows it to be mounted within the seat frame into a compact space which permits low seat styling and yet, the linkage mechanism is concealed and still functions to provide stable rocking as well as gliding action.

14 Claims, 4 Drawing Figures

ROCKING CHAIR

BACKGROUND OF INVENTION

Various types of rocking chairs have, of course, existed for many years. One type utilizes cams or cam surfaces rockable on the floor or a platform such as in a platform rocker. Another type rocks about a fixed axis such as is in a so-called "rocker-box" chair. In yet another type of rocking chair, the chair is suspended from swing arms located externally of the sides of the chair. It is this general category of chair to which the present invention is directed.

OBJECTS OF INVENTION

It is an object of the present invention to provide an improved rocking chair that may be upholstered and designed to meet present-day styling requirements including low seat styling.

It is a further object of the present invention to provide such a chair as described above that will also provide comfortable and stable rocking and gliding action.

A further object of the present invention is to provide a rocking chair that utilizes a linkage mechanism to achieve rocking and gliding action and yet the linkage mechanism is totally concealed within the chair below the seat without sacrificing safety or styling requirements. Included herein is such a chair that may be designed with low-seat styling unimpaired by the linkage mechanism incorporated therein.

A still further object of the present invention is to provide a novel and improved linkage mechanism that may be incorporated in an upholstered chair to provide rocking action.

SUMMARY OF INVENTION

In summary, the rocking chair of the present invention includes a seat, armrest and backrest structure mounted on a fixed base by a linkage mechanism. The latter includes a seat link fixed to the seat frame along the side rail thereof, a stationary base link fixed on the base at a location above the seat link, and a pair of swing arms pivoted at their opposite ends to the seat and base links. The distance between the swing arm pivots on the seat frame is less than the distance between the pivots on the base link and these distances are designed with ratios within a predetermined range to provide safe and effective rocking and gliding action. The seat, armrest and back structure may be upholstered as desired and furthermore, the linkage mechanism may be designed in a compact size allowing lowseat styling in accordance with prevailing tastes.

DRAWINGS

Other objects and advantages of the present invention will become apparent from the following more detailed description taken in conjunction with the attached drawings in which.

DETAILED DESCRIPTION

Figure 2:
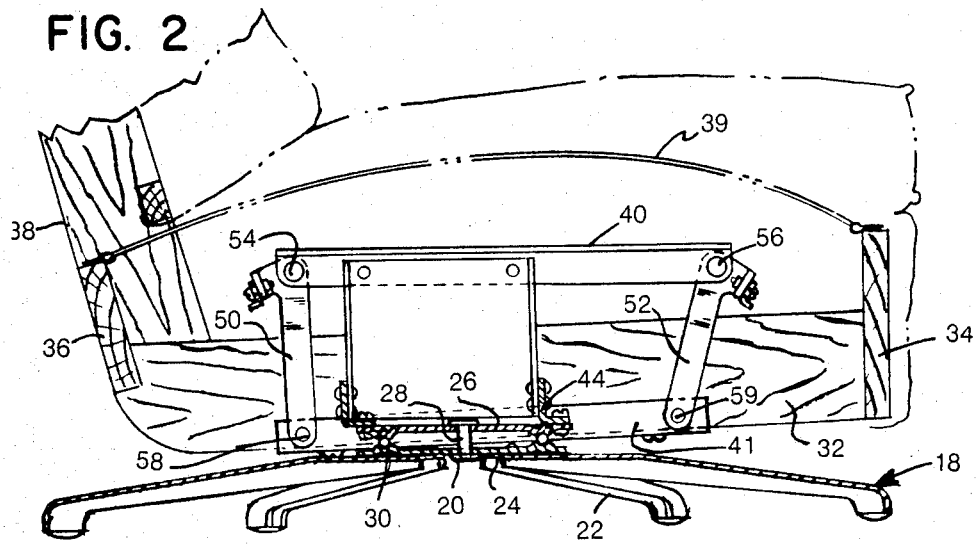
FIG. 2 is a cross-sectional side view of the chair with a part of the backrest broken away.

Referring now to the drawings in detail, there is shown for illustrative purposes only, a rocking chair embodying the present invention. Referring to FIG. 2, the basic parts of the chair include a seat 12, backrest 14 and armrests 16 which, in the specific embodiment, are united together as one structure. In accordance with the invention, this structure is mounted on a base generally designated 18 by means of a novel and improved linkage mechanism generally designated 10 which allows the chair to rock as well as glide relative to the base 18. In the specific embodiment, base 18 includes a swivel generally designated 20 (see FIG. 2) for also providing swiveling motion of the chair about a vertical axis relative to the base. Swivel 20 may include any conventional or other suitable structure such as, for example, upper and lower plates 24 and 26 mounted about a central swivel pin 28 with ball bearings and races generally designated 30 formed between the swivel plates 24 and 26 in typical fashion. The lower swivel plate 24 is fixed to the underlying base structure 18 to be stationary while the upper swivel plate 26 is rotatable about the axis of the swivel pin 28 relative to the lower plate 24 and underlying base structure 18. Although base 18 in the specific embodiment shown includes a plurality of spider legs 22 radiating outwardly from a central area, it will be appreciated that any other suitable base structure may be employed.

Referring now to FIG. 2, seat 12 may have any suitable or conventional frame construction including, for example, side rails 32 (one shown) interconnected by a front rail 34 and a back rail 36 which is also secured against a backrest frame including a rail 38 as shown in FIG. 2. The frame parts just mentioned may be made from wood, as shown, or any other suitable material. Additionally, any conventional seat springs such as designated 39 may be employed. It is preferred that the chair parts be upholstered such as shown for illustrative purposes only in the drawings, so that the linkage mechanism 10, to be described below, will be completely concealed within the chair. Additionally, in accordance with the invention, the chair may be designed to possess a relatively low-seat styling meaning that the seat is positioned from floor within a certain minimum range. The chair, of course, may also include a seat cushion illustrated at 12*a* in FIG. 1 and moreover, the chair may include T-cushion styling where the front ends of seat cushion 12 are positioned beyond the front of armrests 16.

Figure 1:
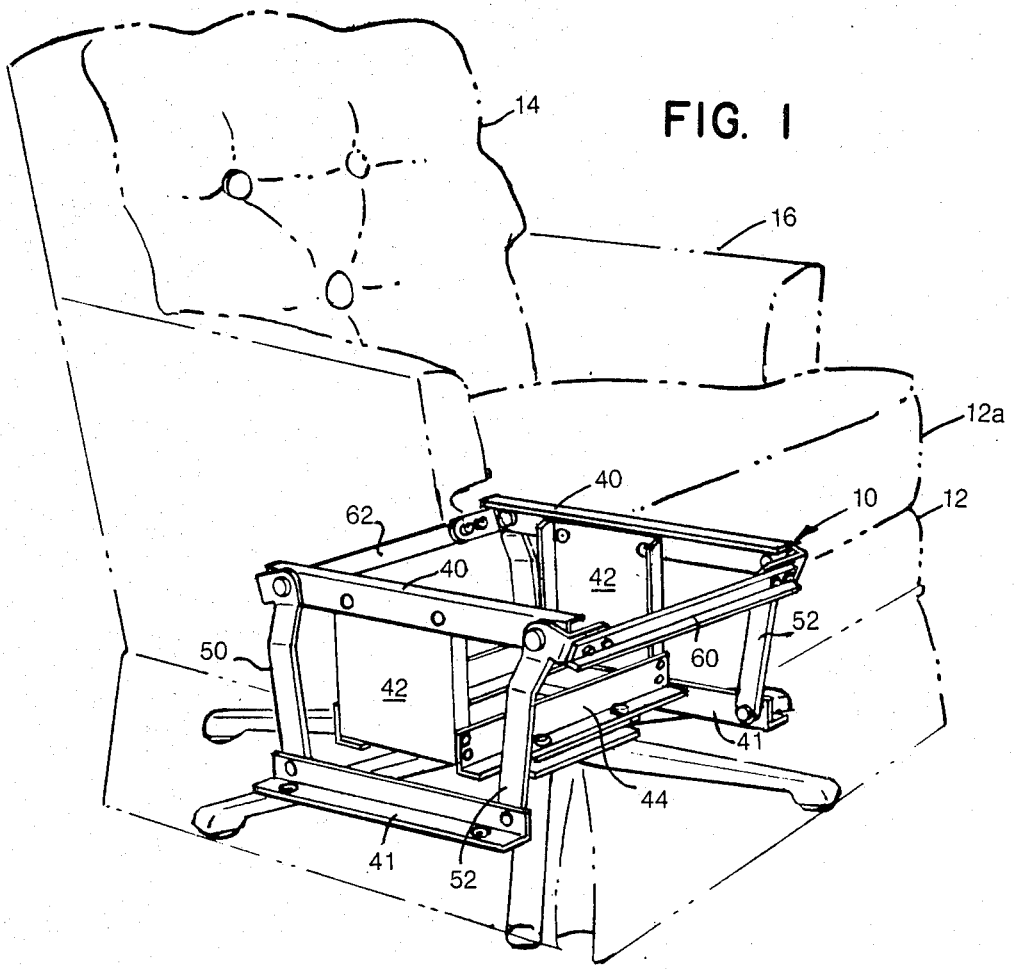
FIG. 1 is a perspective view of a rocking chair embodying the present invention with the upholstered portions thereof shown in phantom lines.

Referring now to FIGS. 1 and 2, linkage mechanism 10 in the preferred embodiment includes a pair of base links 40 fixed relative to the base as will be described, and a pair of seat links 41 fixed respectively to the opposite side rails 32 of the seat frame, preferably on the inner sides thereof. As clearly shown in FIG. 1, seat links 41 are formed as right-angle members so that they may be secured by fasteners through the base thereof and into the bottom surface of seat side rails 32 as best shown in FIG. 2.

The base links 40 are located above the seat links 41 and fixed relative to the base 18 by means of extension members generally designated 42 which, in the specific embodiment shown, are plate members extending in opposite vertical planes from the upper swivel plate 26 to which they are attached by cross members 44, the latter being shown as angle-shaped to provide legs for securing the same to the extensions 42 and swivel plate 26. It will thus be seen that the base links are united with the upper swivel plate 26 to be rotatable about the axis of the swivel pin 28 relative to the lower swivel plate 24 and its associated base structure 22.

Seat 12 is suspended from base links 40 by means of swing arms 50, 52, whose opposite ends are mounted for pivotal or rotational movement to the base link and seat link 41; there being, of course, two pairs of links 50 and 52 mounted to the base links 40 and seat links 41 on opposite sides of the chair. Swing link 50 which, relatively speaking, is pivotally interconnected at the rear end portions of the seat and base links and may be termed a "rear swing link", is pivoted at joint 54 to the base link and at joint 58 to the seat link. The front swing link 52 is pivoted at joint 56 to the base link and at joint 59 to the seat link. In order to provide a minimal tolerance in the pivot joints, it is preferred that they be formed by ball joints rather than pivot pins or rivets conventionally employed in chair linkage mechanisms. This minimizes, if not avoids, undesired noise and bump during motion of the chair that would otherwise be caused by the slack attendant conventional pivot pin joints presently in used in chair mechanisms.

In the preferred embodiment, the swing arms 50, 52 on opposite sides of the chair are interconnected by bars 62 and 60 to integrate the swing arms as well as to reinforce the same against side-sway. In the specific embodiment shown, the upper ends of swing arms 50 and 52 are provided with inwardly projecting flanges to which the bars 60 and 62 are fixed in any suitable fashion.

Figure 3:
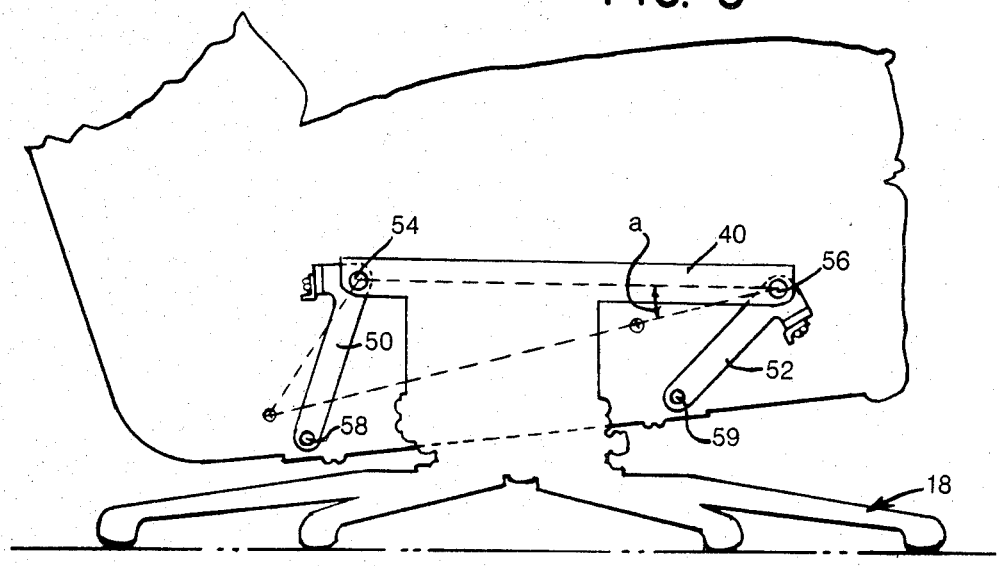
FIG. 3 is a diagrammatic side view of the chair shown in a rearwardly rocked position.
Figure 4:
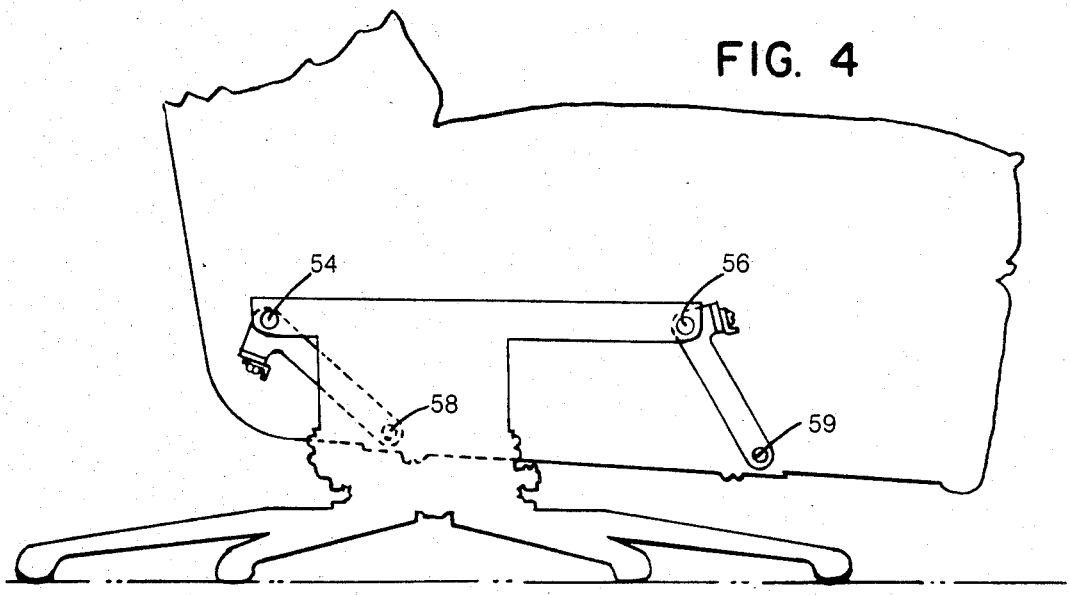
FIG. 4 is a view similar to FIG. 3 but with the chair shown in a forwardly rocked position.

In order to provide rocking action of the seat relative to the base as opposed to purely translatory motion, it is necessary that the distance between the upper pivots 54 and 56 be greater than the distance between the lower pivots 58, 59. It will thus be seen that one occupying the chair may rock the seat and back structure to and fro relative to the base 22 by virtue of the swinging movement of swing arms 50, 52 relative to the seat and base structures. This is illustrated in FIGS. 3 and 4. Moreover, through the use of the swing arms 50, 52, the seat structure also is displaced in the horizontal direction relative to the fixed base as the former undergoes rocking motion along a relatively large arc. This gives a pleasing gliding sensation reminiscent of that produced by porch gliders. In order to allow the seat height of the chair to be designed within a limited range, the distance between the upper pivot joints 54, 56 and lower pivot joints 58, 59 (or the distance between the base and seat links 40, 41 in the specific embodiment) must also be kept within a limited range; however, it was discovered that such limitations could excessively magnify the leverage of the chair and the occupant's momentum during rocking of the chair to produce an unstable condition. In accordance with the invention, it was discovered that the ratio of the distance between the upper pivots 54 and 56 and the distance between the lower pivots 58 and 59 must be such as to be capable of producing a certain obtuse triangle among the four-bar linkage 40, 41, 50 and 52 if the chair were rocked to its rear while being vacant of any occupant. For conventional chair sizes and styling, this triangle which is shown in dotted lines in FIG. 3, must have an angle "a" of at least six degrees (6°) but no greater than sixteen degrees (16°). It has been found that with such specifications, the chair may be easily rocked by the occupant with comfortable gliding action and yet, the occupant's weight will serve to resist any excessive rocking action so as to provide a safe chair. At the same time, the linkage mechanism is fully concealed within the chair without sacrificing low-seat styling requirements or other present-day design criteria. Indeed, the chair of the present invention may take its place in any living or sitting room.

Although the present invention has been illustrated in a chair incorporating a swivel, it will be apparent that the invention may be incorporated in chairs without a swivel. Furthermore, the invention may be incorporated in chairs where the backrest is movable relative to the seat or in other action chairs such as recliner chairs.

What is claimed is:

1. A rocking chair comprising a stationary base, a seat and backrest structure including a seat frame having opposite side portions and upholstery on the seat including seat springs, armrests fixed to opposite sides of the seat frame, and linkage means within the seat frame suspending the seat at said side portions from the base for rocking movement along an arc during which the seat is also displaced in a horizontal plane relative to the base, said linkage means being located below said seat springs and inwardly of said armrests and said opposite side portions of said frame, and wherein said linkage means includes two pairs of front and rear swing arms each having opposite portions pivotally mounted at pivot joints to the base and seat frame at opposite sides thereof, the distance between the pivot joints on the base being greater than the distance between the pivot joints on the seat frame, and wherein there is further included transverse anti-sway bars interconnecting the swing arms on opposite sides of the seat frame.

2. The chair defined in claim 1 wherein the linkage means is concealed from external view.

3. The chair defined in claim 2 wherein said armrests, backrest and armrests are upholstered.

4. The rocking chair defined in claim 1 wherein said swing arms together with said base and seat frame form a four bar-linkage dimensioned such that in one position the four-bar linkage forms an obtuse triangle forming an angle between the longest side and the side adjacent thereto of at least six degrees but no greater than sixteen degrees.

5. The rocking chair defined in claim 4 wherein said linkage means further includes a seat link fixed to the seat frame and a base link fixed to the base above the seat link, and wherein said swing arms are pivotally mounted to said seat link and base link at said pivot joints.

6. The chair defined in claim 5 wherein said base includes a lower stationary portion and an overlying rotational portion and a swivel means mounting said overlying base portions on said lower base portion for rotation about a vertical axis, said seat link being fixed to said overlying base portion.

7. The chair defined in claim 6 wherein said overlying base portion includes a vertical extension to which said base link is fixed at an upper portion of the riser.

8. The chair defined in claim 7 wherein said base includes a lower stationary portion, an upper rotatable portion overlying said lowest stationary portion, and a swivel means mounting the upper portion to the lower portion for rotation about a vertical axis, and wherein said extension is fixed to said upper base portion.

9. The chair defined in claim 8 further including ball joints forming said pivot joints.

10. A linkage mechanism for mounting a seat frame to a base for rocking movement relative thereto, the mechanism comprising a base link adapted to be fixed relative to an associated chair base, a seat link located below said base link and adapted to be fixed relative to an associated chair-seat-frame, a pair of front and rear swing arms located inwardly of said seat frame and each pivotally mounted at opposite portions thereof to said base and seat link to form a four bar linkage wherein the seat links are suspended from said base link for swinging movement relative thereto along an arc of travel, the distance between the pivots on the base link being greater than the distance between the pivot on the seat link and said base and seat links and said swing arms being dimensioned such that in one position of the four bar linkage straight lines drawn between the pivots on the base link, and between the pivots on the base link and the pivot of the rear swing link to the seat link will form an obtuse triangle having an angle formed by the longest side and the side adjacent thereto of at least six degrees but not greater than sixteen degrees.

11. The mechanism defined in claim 10 further including an extension member fixed to the base link at an upper portion of the extension member and adapted to be fixed to an associated chair base to project above the latter.

12. The mechanism defined in claim 10 wherein said seat link has a right angle cross section for mounting the seat link to a lower edge of an associated seat frame with the seat link being located inwardly of the seat frame.

13. A rocking seat comprising a base, a seat and backrest structure including a seat frame having opposite side portions and opposite front and rear portions, and linkage means suspending the seat at said side portions from the base for rocking movement along an arc during which the seat is also displaced in a horizontal plane relative to the base, said linkage means including opposite seat links fixed respectively to said opposite side portions of the chair frame, opposite base links located above the seat links respectively and inwardly of the opposite side portions of the seat frame, opposite extension members fixed to the base and projecting upwardly therefrom, said base links being fixed to upper portions of said extension members respectively, two pairs of swing arms located inwardly of the opposite side portions and the opposite front and rear portions of the seat frame and pivotally mounted to the base links respectively and pivotally connected to the seat links respectively to suspend the seat frame from the base links for said rocking movement relative thereto, a pair of anti-sway bars interconnecting said swing arms on opposite sides of the seat frame and being located inwardly of the opposite side portions and the opposite front and rear portions of the seat frame, and wherein said base includes a lower stationary portion, an upper rotatable portion, and swivel means mounting the upper base portion on said lower base portion for movement about a vertical axis, said extension members being fixed to said upper base portion.

14. A rocking chair comprising a base, a seat and backrest structure including a seat frame having opposite side portions including armrests and opposite front and back portions extending between said side portions, and linkage means suspending the seat at said side portions from the base for rocking movement along an arc during which the seat is also displaced in a horizontal plane relative to the base, said linkage means including opposite seat links fixed respectively to said opposite side portions of the seat frame, opposite base links located above the seat links respectively, two pairs of front and rear swing arms pivotally mounted to the base links respectively and pivotally connected to the seat links respectively to form a four bar linkage suspending the seat frame from the base links for said rocking movement relative thereto, said swing arms being located inwardly of the opposite side portions and armrests and inwardly of said front and back portions of the seat frame, the distance between the pivots of the swing arms on the base links being greater than the distance of the pivots of the swing arms on the seat link, and said base and seat links and said swing arms being dimensioned such that in one position of the four bar linkage straight lines drawn between the pivots on one base link, and between the pivots on said one base link and the pivot of the rear swing arm to the associated seat link will form an obtuse triangle having an angle formed by the longest side and the side adjacent thereto of at least six degrees but not greater than sixteen degrees, and said base including a lower stationary portion, an upper rotatable portion, and swivel means mounting the upper base portion on said lower base portion for movement about a vertical axis.

* * * * *